US006267259B1

(12) United States Patent
Shiwaku

(10) Patent No.: US 6,267,259 B1
(45) Date of Patent: Jul. 31, 2001

(54) OVERHEAD TRAVELLING CARRIAGE

(75) Inventor: Tamotsu Shiwaku, Kani (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/468,824

(22) Filed: Dec. 22, 1999

(30) Foreign Application Priority Data

Dec. 25, 1998 (JP) ..... 10-368997

(51) Int. Cl.[7] ..... B66C 19/00
(52) U.S. Cl. ..... 212/330; 212/317; 212/318
(58) Field of Search ..... 212/317, 318, 212/224, 315, 330

(56) References Cited

U.S. PATENT DOCUMENTS

| | | | | |
|---|---|---|---|---|
| 666,123 | * | 1/1901 | Wellman et al. | 212/318 |
| 1,367,907 | * | 2/1921 | Andrews | 212/224 |
| 2,553,378 | * | 5/1951 | Miller | 212/318 |
| 3,061,111 | * | 10/1962 | Riemenschneider | 212/318 |
| 4,750,132 | * | 6/1988 | Pessina et al. | 212/318 |
| 5,492,443 | * | 2/1996 | Crorey et al. | 212/224 |

FOREIGN PATENT DOCUMENTS

| | | | | |
|---|---|---|---|---|
| 750697 | * | 1/1967 | (CA) | 212/224 |
| 2761453 | * | 10/1978 | (DE) | 212/224 |
| 9-77474 | | 3/1997 | (JP) . | |
| 2845067 | | 10/1998 | (JP) . | |

* cited by examiner

*Primary Examiner*—Thomas J. Brahan
(74) *Attorney, Agent, or Firm*—Armstrong, Westerman, Hattori, McLeland & Naughton, LLP

(57) ABSTRACT

A through-hole 14 is provided in a body base 12 of an overhead travelling carriage to guide a roller on an elevating and lowering drive section 6. In addition, a pair of holes are provided at the both running-direction ends of the elevating and lowering drive section 6 to guide rollers on position control sections 16, 16. The pair of position control sections 16, 16 independently move these rollers perpendicularly to a running direction.

A simple mechanism can be used to move an elevating and lowering section of the overhead travelling carriage perpendicularly to the running direction and to rotationally move it in a horizontal direction so as to reach a station.

2 Claims, 3 Drawing Sheets

OVERHEAD TRAVELLING CARRIAGE

FIELD OF THE INVENTION

The present invention relates to an overhead travelling carriage, and in particular, to the control of the position of the overhead travelling carriage relative to a station.

BACKGROUND OF THE INVENTION

An overhead travelling carriage runs along a running rail provided near a ceiling of a factory or a warehouse in order to transfer and load articles on stations. The overhead travelling carriage comprises, for example, a body, an elevating and lowering drive section, and an elevating and lowering section driven by the elevating and lowering drive section to elevate and lower to chuck an article. If any station is offset from a position immediately under the running rail, it is difficult to transfer articles between the overhead travelling carriage and this station. In addition, the transfer is difficult when the station requires chucking from a predetermined direction and if the overhead travelling carriage is offset from this direction. Correcting these points requires a complicated mechanism in the overhead travelling carriage.

An object of the present invention is to use a simple configuration to enable a locational offset from a station perpendicular to the running direction of the overhead travelling carriage or an directional offset from a station within a horizontal plane to be corrected in order to transfer and load articles on these stations.

An additional object of the invention is to provide a simple mechanism for movements perpendicular to the running direction and rotational movements within a horizontal plane.

An additional object of the invention is to provide a configuration for enabling the elevating and lowering drive section to be moved or rotationally moved in a horizontal direction.

SUMMARY OF THE INVENTION

The present invention is an overhead travelling carriage comprising a body running along a running rail and an elevating and lowering drive section provided under the body to drive the elevating and lowering section, characterized in that the elevating and lowering section is installed on the body so as to be moved perpendicularly to a running direction and to be rotationally moved in a horizontal direction.

Preferably, a position control means is provided to independently move the both running-direction ends of the elevating and lowering section perpendicularly to the running direction.

Furthermore, it is preferable that a rotationally moving shaft be provided on the elevating and lowering drive section, and that a member for guiding the rotationally moving shaft so as to rotationally move in a horizontal direction and to move perpendicularly to the running direction be provided on the bottom of the body.

DETAILED DESCRIPTION OF THE PREFERRED EMBODIMENTS

Figure 1:
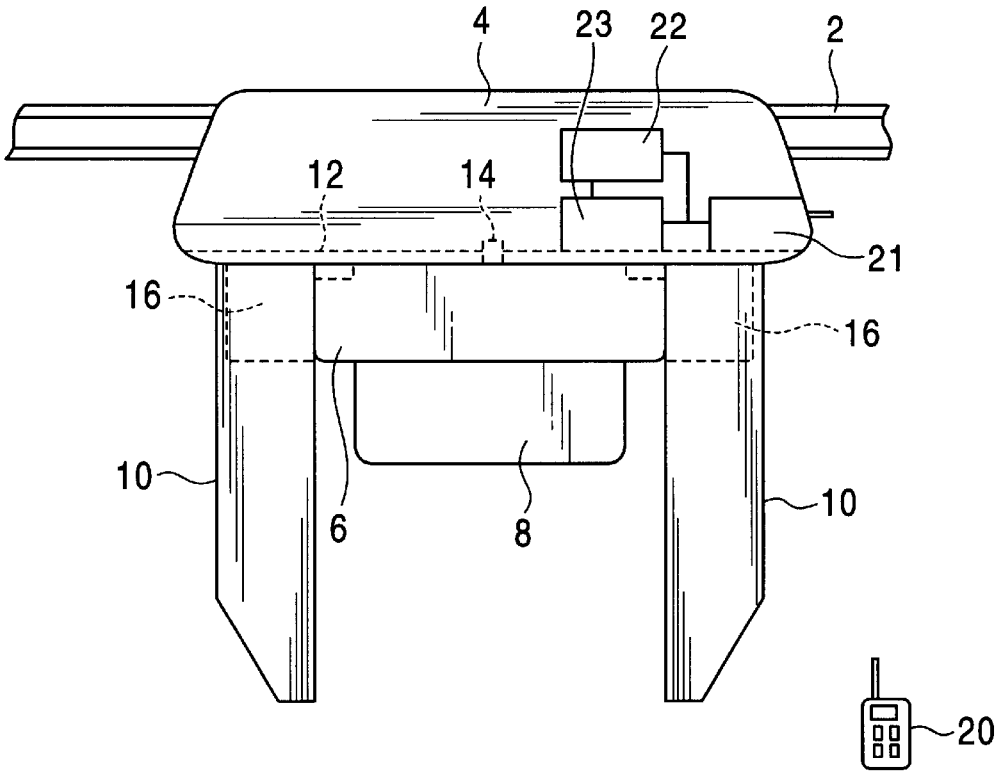
FIG. 1 is a side view of an overhead travelling carriage according to an embodiment.

FIGS. 1 to 5 show an embodiment. FIGS. 1 to 4 show an overhead travelling carriage according to the embodiment, 2 is a running rail laid near a ceiling of a factory or a warehouse. 4 is the body of an overhead travelling carriage, 6 is an elevating and lowering drive section mounted on the bottom surface of the body so as to be moved perpendicularly to a running direction and to be rotationally moved within a horizontal plane, and 8 is an elevating and lowering section mounted on the bottom surface of the elevating and lowering drive section so as to elevate and lower. 10, 10 are a pair of longitudinal covers for the elevating and lowering drive section 6 that are used to protect an article chucked by the elevating and lowering section 8.

12 is a body base provided near the bottom surface of the body 4 having a through-hole 14 at the center in the longitudinal direction (the running direction of the overhead travelling carriage). 16, 16 are position control sections provided, for example, at the positions of the covers 10, 10 and mounted on the body base 12 so that rollers on the position control rollers are inserted into a pair of holes 18, 18 provided at the both running-direction ends of the elevating and lowering drive section 6 to control the position of the elevating and lowering drive section 6.

20 is a control section for allowing the overhead travelling carriage to be manually controlled, 21 is a teaching acceptance section, 22 is a transfer and loading data storage section, and 23 is a control section. In response to a signal from the control section 20, the teaching acceptance section 21 accepts the start of a teaching operation, and the overhead travelling carriage operates according to the signal from the control section 20. Operations performed in this case, in particular, the rotational movement of the elevating and lowering drive section 6 within a horizontal plane, the movement of the elevating and lowering drive section 6 perpendicular to the running direction, the elevating and lowering operations of the elevating and lowering drive section 6, and a chucking operation of the elevating and lowering section 8, which are all required to transfer and load articles, are stored in the transfer and loading data storage section 22 as transfer and loading data. 23 is a control section for controlling the position (a position perpendicular to the running direction and a direction associated with a rotational movement within a horizontal plane) of the elevating and lowering drive section 6 while controlling the elevating and lowering section 8 via the elevating and lowering drive section 6, during playback according to the transfer and loading data stored in the transfer and loading data storage section 22.

Figure 2:
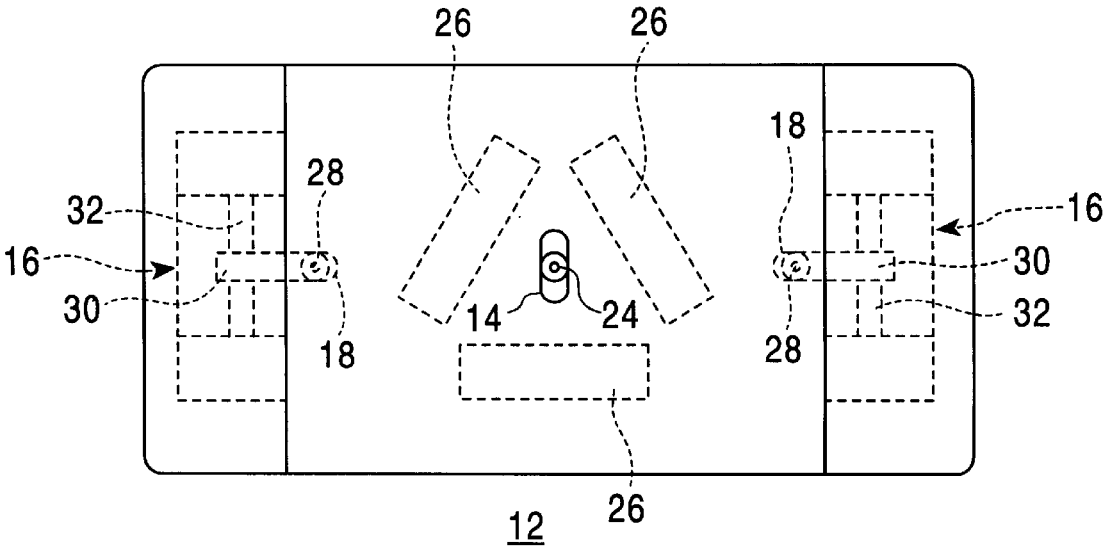
FIG. 2 shows the bottom surface of the body of the overhead travelling carriage according to the embodiment.
Figure 3:
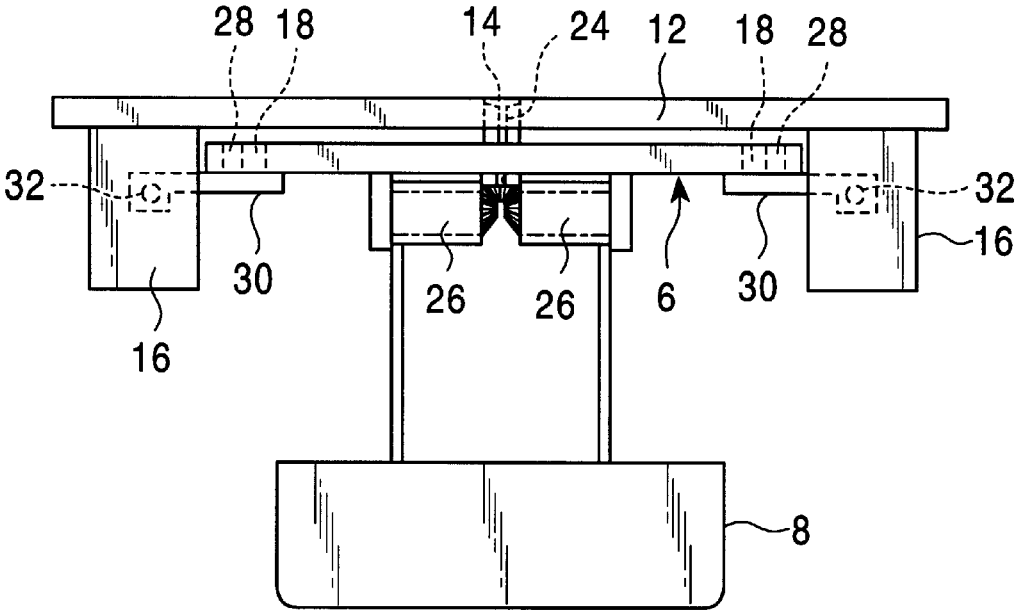
FIG. 3 is a side view of the integral part of the overhead travelling carriage according to the embodiment.
Figure 4:
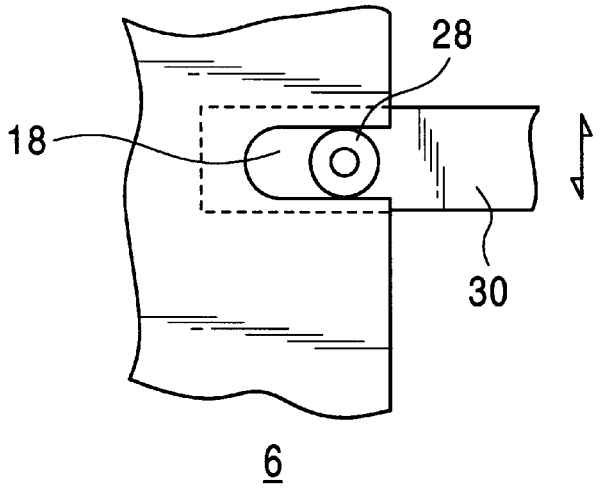
FIG. 4 is an enlarged top view of the integral part of the overhead travelling carriage according to the embodiment showing a connection between an elevating and lowering drive section and a position control section.

FIG. 2 shows the body base 12 as seen from its top surface, and FIG. 3 shows the body base 12, the elevating and lowering drive section 6, and the position control section 16 as seen from their sides. A through-hole 14 is provided at the center along the running direction of the body base 12 so that a roller 24 mounted at the top of the elevating and lowering drive section 6 is inserted into the through-hole 14 to guide the elevating and lowering drive section 6. Thus, the roller 24 can be rotationally moved within the through-hole 14 and moved perpendicularly to the running direction.

In addition, 26 is, for example, three winding drums provided on the elevating and lowering drive section 6 to elevate and lower the elevating and lowering section 8. A pair of holes 18, 18 are provided at the both running-direction front and rear ends of the elevating and lowering drive section 6, and a roller 28 connected to the position control section 16 is inserted into the hole 18 as shown in the enlarged view in FIG. 4. The bottom surface of the roller 28 is borne by an arm 30 coupled to a bar screw 32, etc. to the position control section 16.

By using a motor and a brake (not shown in the drawings) in the position control section to control the rotation of the bar screws 32, 32, the longitudinal pair of arms 30, 30 can be independently moved perpendicularly to the running direction. In this case, loads from the elevating and lowering drive section 6 are received by the arms 30, 30 extending along the bottom surface of the hole 18, and the longitudinal pair of position control section 16, 16 operate independently, so the elevating and lowering drive section 6 can perform two operations including the movement perpendicular to the running direction and the rotational movement in a horizontal plane.

In this manner, by moving the longitudinal pair of arms 30, 30 in the same direction by the same amount, the elevating and lowering drive section 6 makes a parallel movement perpendicular to a horizontal plane. At this point, the roller 24 is guided by the through-hole 14 relative to the body 4 while being rotationally moved, resulting in a smooth movement.

On the other hand, if the elevating and lowering drive section 6 is rotationally moved in the horizontal direction, the longitudinal pair of rollers 28, 28 are moved in opposite directions. Then, the elevating and lowering drive section 6 is moved in a horizontal plane around the roller 24 in the through-hole 14. Actually required operations are the rotational movement within a horizontal plane and the movement perpendicular to the running direction, and combining the above two types of movements enables the rotational movement within a horizontal plane and the movement perpendicular to the running direction to be arbitrarily executed. Most stations, however, are provided nearly immediately under the running rail 2, so they are subjected to only a small lateral positional offset from a position immediately under the running rail 2. Accordingly, the elevating and lowering drive section 6 requires only a small range of position control for the movement perpendicular to the running direction and the rotational movement in the horizontal direction.

Figure 5:
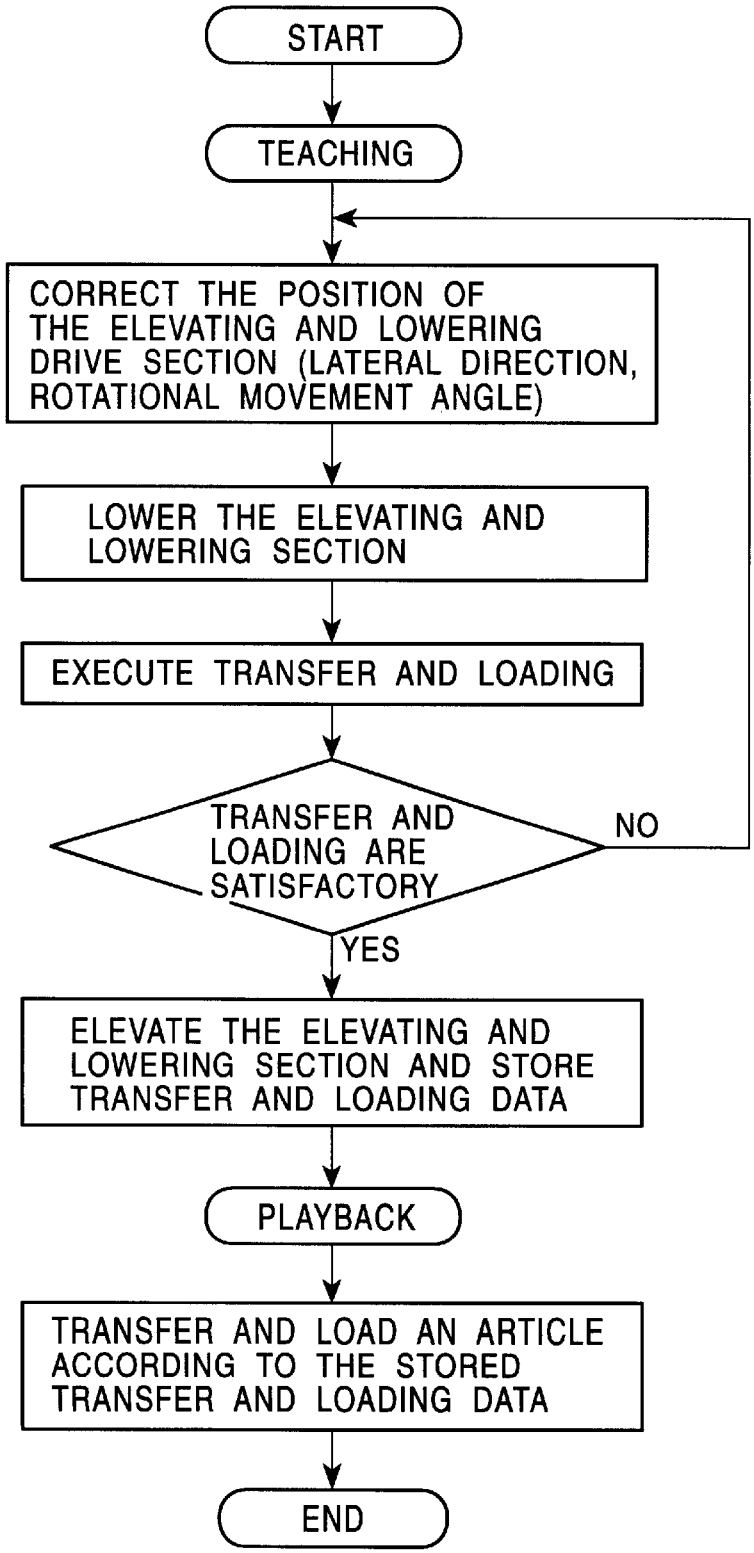
FIG. 5 is a flow chart showing teaching in the overhead travelling carriage according to the embodiment.

FIG. 5 shows teaching for the position of the elevating and lowering drive section 6. Teaching is started once the overhead travelling carriage has been stopped at a predetermined position after manual run via the control section 20. During teaching, the position of the elevating and lowering drive section 6 is controlled by the control section 20. After the control of the position has been finished, the elevating and lowering section 8 is again manually lowered to transfer and load an article on a station (not shown in the drawings). If the transfer and loading have been finished satisfactorily, data on the position of the elevating and lowering drive section 6, the lowering of the elevating and lowering section 8, and a chucking operation is stored in the transfer and loading storage section 22 as transfer and loading data. Otherwise, for example, the above procedure is repeated until satisfactory transfer and loading have been carried out. Teaching is finished once the above operation has been performed for each station along the running rail 2.

During playback, the overhead travelling carriage is run to a predetermined station, where the position of the elevating and lowering drive section 6 is controlled according to the transfer and loading data stored in the transfer and loading data storage section 22. Then, the elevating and lowering section 8 is lowered, an article is chucked and delivered, and the reverse operation is performed to complete transfer and loading.

Although in the embodiment, the hole 18 is provided in the elevating and lowering drive section 6 and the roller 28 is inserted from the position control section 16, this operation may be reversed in such a way that the longitudinal pair of arms are inserted into the position control section 16 from the elevating and lowering drive section 6 to move the arm inserted into the position control section 16.

According to the present invention, the elevating and lowering section is installed on the body of the overhead travelling carriage so as to move perpendicularly to the running direction and to rotationally move in the horizontal direction. Thus, an article can be delivered even if the station is offset from a position immediately under the running rail or if there is a directional offset between the station and the overhead travelling carriage.

According to the invention, the both running-direction ends of the elevating and lowering section are independently moved perpendicularly to the running direction. When the opposite ends are moved perpendicularly to the running direction over the same direction, the elevating and lowering drive section and the elevating and lowering section thereunder are moved in parallel and perpendicularly to the running rail. On the other hand, when the both running-direction ends of the elevating and lowering section are moved in opposite directions, the elevating and lowering drive section is rotationally moved in a horizontal plane. By combining these movements, both the movement perpendicular to the running direction and the rotational movement within a horizontal plane can be carried out using a simple mechanism.

According to the invention, a rotationally moving shaft is provided on the elevating and lowering drive section, and is guided by the body so as to rotationally move and to move perpendicularly to the horizontal direction. This configuration smoothes the rotational movement of the elevating and lowering drive section within a horizontal plane and its movement perpendicular to the horizontal direction.

What is claimed is:

1. An overhead travelling carriage, comprising:

a body running along a running rail; and an elevating and lowering drive section provided under the body;

an elevating and lowering section suspended from the elevating and lowering drive section, said elevating and lowering drive section elevating and lowering said elevating and lowering section;

said elevating and lowering drive section is rotatable about a rotationally moving shaft perpendicular to a horizontal plane and is also horizontally movable in a direction perpendicular to a longitudinal direction of said running rail, and first and a second position control means, each provided at fore and rear ends of said elevating and lowering drive section with respect to the longitudinal direction of said running rail, for moving said elevating and lowering drive section in the direction perpendicular to the longitudinal direction of said running rail and rotating said elevating and lowering drive section within the horizontal plane, wherein said first and second position control means move independently of each other.

2. The overhead travelling carriage according to claim 1, wherein said rotationally moving shaft is provided on the elevating and lowering driving section, and a member for guiding the rotationally moving shaft is provided on the bottom of said body to rotationally move in a horizontal plane and to move in a direction perpendicular to the longitudinal direction of the running rail.

* * * * *